United States Patent [19]

Box

[11] 4,267,984

[45] May 19, 1981

[54] METHOD AND APPARATUS FOR SEPARATING STRIP COIL FROM WOUND CONSTRUCT BY ROTATION

[75] Inventor: William A. Box, Bethel Park, Pa.

[73] Assignee: United States Steel Corporation, Pittsburgh, Pa.

[21] Appl. No.: 129,965

[22] Filed: Mar. 13, 1980

[51] Int. Cl.[3] ..... B65H 35/02; B26F 3/00

[52] U.S. Cl. ..... 242/56.4; 225/93; 225/103

[58] Field of Search ..... 242/56.4, 56.1, 78.6, 242/78.7, 78.8; 225/93, 103

[56] References Cited

U.S. PATENT DOCUMENTS

| | | | |
|---|---|---|---|
| 2,742,965 | 4/1956 | Drummond | 225/93 X |
| 3,904,097 | 9/1975 | Grambo | 225/103 |
| 4,191,318 | 3/1980 | Rogers | 242/56.4 |
| 4,195,759 | 4/1980 | Rogers | 225/103 |

*Primary Examiner*—Edward J. McCarthy
*Attorney, Agent, or Firm*—John F. Carney

[57] ABSTRACT

Apparatus and method are described which are effective for detaching a coiled strip from a wound construct containing a plurality of coiled strips interconnected by intermittently spaced tabs that bridge the parting lines between adjacent strips. The apparatus is adapted to conveniently fracture the tabs in a manner which prevents distortion or marring of the adjacent strip material. The separated strip is caused to be wound into a tighter coil to facilitate subsequent handling thereof.

6 Claims, 4 Drawing Figures

METHOD AND APPARATUS FOR SEPARATING STRIP COIL FROM WOUND CONSTRUCT BY ROTATION

BACKGROUND OF THE INVENTION

An improved practice for the production of coiled sheet metal strip material is described in U.S. Pat. Nos. 4,155,238, 4,170,691 and 4,173,313 granted May 22, 1979, Oct. 9, 1979 and Nov. 6, 1979, respectively, to John W. Rogers. According to this improved practice an elongated web of sheet metal is slit along parallel lines in a manner that produces parting lines containing intermittently spaced residuums of only partially sheared metal that bridge the parting line between adjacent strips and interconnect their facing edges. Thus, upon coiling of the slit product there results a wound construct containing a plurality of coiled strips integrally joined by frangible connections or tabs defined by the afore-mentioned partially sheared residuums of metal.

Detachment of individual strips from the construct can be effected by a breakaway device such as that described in U.S. patent application Ser. No. 898,001, now U.S. Pat. No. 4,191,318, to John W. Rogers filed Apr. 20, 1978, now U.S. Pat. No. 4,195,759, granted Apr. 1, 1980 in which all the interconnecting tabs in the parting line to be separated are fractured substantially simultaneously by the application of a shear force directly to the concerned strip coil. Separating coils in this manner requires great forces due to the requirement to break all the tabs substantially together. The magnitude of the forces that must be applied to the web material requires the use of heavy, expensive equipment. It furthermore places the material in danger of being damaged due to deformation of the coiled strip selected for removal or of the remaining construct.

The above problem is avoided, however, through the use of an alternate form of apparatus, such as that described in U.S. patent application Ser. No. 055,848 to John W. Rogers filed July 9, 1979 in which the tabs in each parting line to be severed are fractured sequentially by paying the concerned strip over a wedge-like body. Use of this apparatus significantly reduces the degree of force required to separate the strip; however, removal of the strip in coil form is precluded unless, of course, the payed out strip is subsequently rewound into a coil.

It is to an improved method of and apparatus for detaching coiled strips from a wound cluster, therefore, that the present invention is directed.

SUMMARY OF THE INVENTION

Accordingly, the present invention provides a method of fracturing tabs for detaching a coiled strip from a wound construct of web material comprising a plurality of axially spaced parting lines defining a plurality of axially spaced strip coils, the strips being frangibly interconnected in side-by-side relation by intermittently spaced tabs bridging the parting line between adjacent strips comprising te steps of grasping the free end of the coiled strip to be separated at the inner diameter thereof; and imparting relative rotational movement between said strip and the remainder of the construct to cause the grasped strip to undergo a reduction in diameter in relation to that of said construct remainder.

There is also provided by the present invention, for use in combination with a wound construct of web material having an axial opening therethrough and containing a plurality of axially spaced strip coils defined by winding an elongated web having a plurality of laterally spaced parting lines forming strips therebetween, said strips being interconnected in side-by-side relation by intermittently spaced tabs bridging the parting line between adjacent strips, apparatus for detaching a strip coil from said construct by fracturing said interconnecting tabs comprising a body having an effective exterior surface of a diameter to be received in said axial opening; means on said body for attaching the free end of the strip; and means for rotating said body.

It is accordingly a principle object of the invention to provide an improved method of and apparatus for detaching sheet metal strip material from an integrated coil construct without damaging or distorting the strip material.

Another object of the invention is to provide a method of and apparatus for detaching the strip coils from the construct at reduced force requirements while retaining the detached material in a wound configuration.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT OF THE INVENTION

Figure 1:
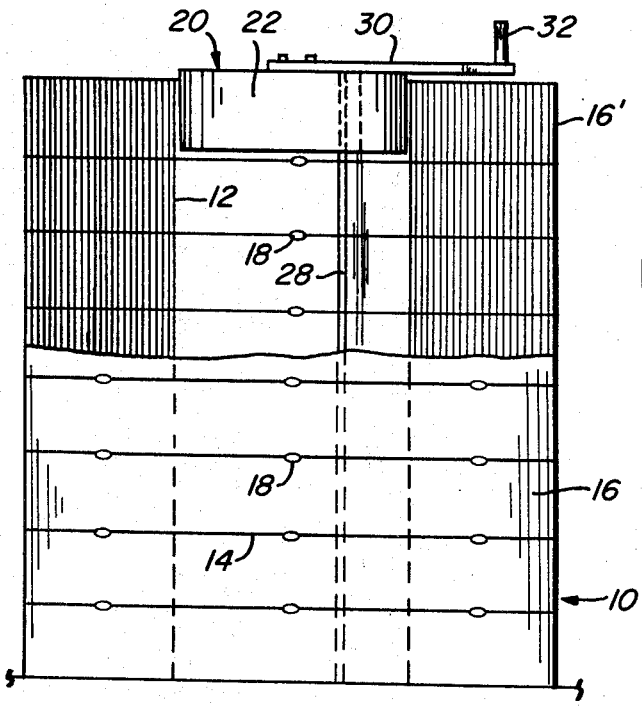
FIG. 1 is an elevational schematic view partly in section illustrating the inventive apparatus in operational position within a wound sheet metal construct.

FIG. 1 of the drawing illustrates, somewhat schematically, a wound coil construct 10 of elongated web material here shown as being bottom supported on end such that the axial opening 12 therethrough is upstanding. It should be appreciated, however, that the invention is equally applicable to a coil construct 10 whose opening 12 may be horizontally disposed. The coil construct 10 is of a type described in U.S. Pat. No. 4,170,691, being formed of wound sheet metal web material having a plurality of laterally spaced parting lines 14 defining coiled strips 16 therebetween. The parting lines 14 contain intermittently spaced tabs, schematically represented at 18, formed of partially sheared residual web material bridging the interstice between adjacent strips 16 and defining frangible interconnections therebetween. As described more completely in U.S. Pat. No. 4,155,238, the construct 10 is fabricated by rotary slitting cutters which operate on an elongated web of sheet metal material in a manner whereby, along the parting lines 14, the web is sheared continuously. Over a predominant portion of the length of each parting line 14 shearing extends to the point of severence of the web but at intermittently spaced locations along the parting lines shearing of the web is terminated short of that required for severence thereby producing a residuum of only partially sheared metal that forms a tab 18 interconnecting adjacent strips 16. The fabricated web is passing from the slitting cutter is wound upon a recoiler with the resultant construct typically containing a great number of wraps of the wound web material.

According to the present invention, means are provided for effectively separating coiled strips 16 from the construct 10 in a manner that permits the strips to retain their coiled configuration upon separation. Such separator means, indicated generally in the drawings as 20, comprises an annular body 22 that is telescopically received for rotational movement in the axial opening 12 of the construct 10. The diameter of the body 22 is preferably sized to produce a clearance gap 24 between the facing surfaces of the body and the construct opening in order to reduce the effect of friction between adjacent coil wraps upon rotation of the separator and thereby the amount of force required to separate a strip selected for detachment. Such strip is indicated in the drawings as 16' in order to distinguish it from the other strips 16 in the remainder of the construct.

The body 22 is provided with means for attaching the free end 28 of the strip 16' to be separated, such means being shown in the illustrated embodiment as gripper slot 26 extending transversely of the body surface. In practice, the free end 28 of sheet metal strip material is conveniently adapted for reception in the slot 26 in that an inturned tang typically results during recoiling following a slitting operation by the deformation of the metal by the gripper apparatus of a recoiler mandrel upon which the metal is wound.

In its simplest form, as shown, the body 22 can be manually rotatably driven within the construct 10 by the provision of an operating lever 30 fixed to the body and provided with a handle 32 adjacent its free end.

Figure 2:
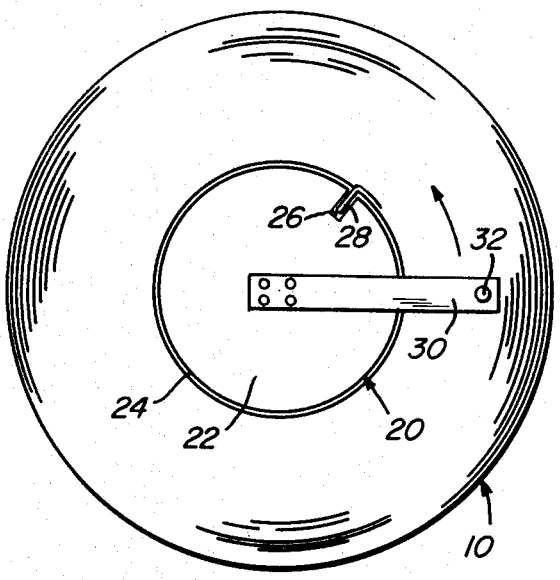
FIGS. 2, 3 and 4 are plan views illustrating the apparatus in various rotated positions as separation of the strip coil progresses.
Figure 3:
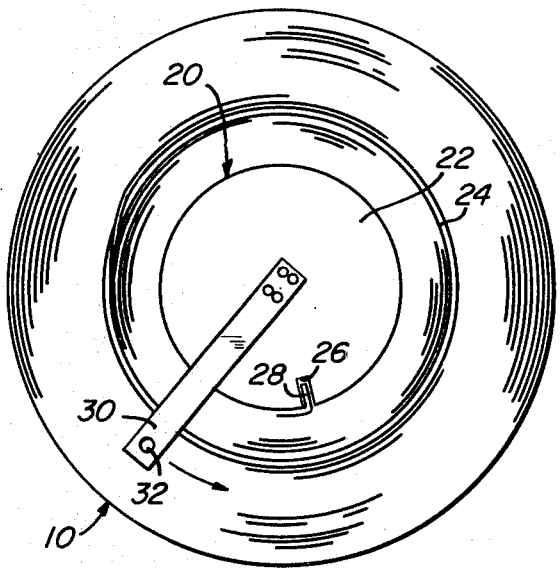
Figure 4:
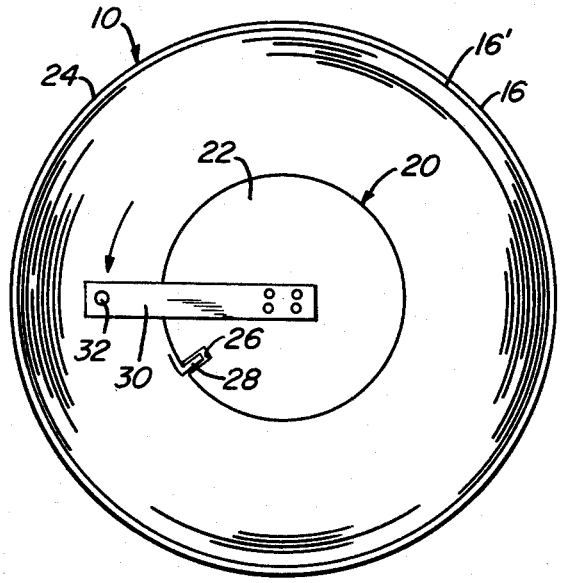

In operation, the body 22 is inserted into the axial opening 12 of the construct 10 and the free end 28 of the strip 16' to be separated is placed within the gripper slot 26. Thereafter apparatus 20 is imparted with a rotational motion in a direction opposite to that in which the strip 16' is wound thereby causing the selected strip 16' to traverse the gap 24 and wind down relatively tightly on the surface of the body 22. Continued rotation of the apparatus 20 causes each succeeding wrap in the coil to wind upon the preceding wrap. As the wraps are wound the gap 24 appears to expandingly translate through the coil as shown in FIGS. 2, 3 and 4. The so-produced relative movement between the strip 16' being wound and the remainder of the construct thus creates a tensile-shearing action sequentially on each tab 18 that connects the strip 16' to its adjacent strip 16 in the remaining construct until the selected strip 16' is completely separated by the sequential fracture of all the tabs 18 connecting it to the construct 10. The effect of friction on the operation is substantially eliminated since fracture of the tabs 18 occurs as the succeeding wraps in the coil traverse the space provided by the gap 24. When separation is complete, the strip 16' is wound to slightly reduced diameter with respect to that of the remaining construct as seen in FIG. 4. It can then be detached from the separator 20 and conducted away by available transport means to a point of use.

It will be appreciated that, although the described embodiment is operative to remove a single strip coil from the construct, the number of multiple, interconnected strip coils that can be separated from the construct is dependent only on the number of strip coils whose internal free ends can be attached to the separator body. Thus, where it is desired to remove plural strip coils, a body having an axial length sufficient to provide a gripper slot 26 effective to attach the number of coil strips selected for separation is all that is required.

It should be further appreciated that mechanical means can be employed to rotate the body 22. Surprisingly, however, in actual practice, a single workman employing a separating device substantially similar to that illustrated in the drawings herein has, without undue effort, been able to completely separate an approximately two-inch wide strip coil of 0.082 gage sheet metal from a three-foot diameter construct having 83 wraps. Complete separation of the strip coil was achieved within only about one and one-quarter turns of the separator.

It will be understood that various changes in the details, materials and arrangements of parts which have been herein described and illustrated in order to explain the nature of the invention, may be made by those skilled in the art within the principle and scope of the invention as expressed in the appended claims.

I claim:

1. A method of fracturing tabs for detaching a coiled strip from a wound construct of web material comprising a plurality of axially spaced strip coils, the strips being frangibly interconnected in side-by-side relation by intermittently spaced tabs bridging the parting line between adjacent strips comprising the steps of:

(a) grasping the free end of the strip to be separated at the inner diameter thereof; and (b) imparting relative rotational movement between said strip and the remainder of the construct to cause the grasped strip to undergo a reduction in diameter in relation to that of said construct remainder.

2. A method according to claim 1 in which the strip to be separated is wound to a diameter smaller than its original diameter.

3. For use in combination with a wound construct of web material having an axial opening therethrough and containing a plurality of axially spaced strip coils defined by winding an elongated web having a plurality of laterally spaced parting lines forming strips therebetween, said strips being interconnected in side-by-side relation by intermittently spaced tabs bridging the parting line between adjacent strips, apparatus for detaching a strip coil from said construct by fracturing said interconnecting tabs comprising:

(a) a body having an effective exterior surface of a diameter to be received in said opening;

(b) means on said body for attaching the free end of the strip to be removed; and (c) means for rotating said body.

4. Apparatus according to claim 3 in which the effective exterior surface of said body is sized to produce a clearance space between it and said construct opening.

5. Apparatus according to claim 3 or 4 in which said body has a cylindrical exterior surface.

6. Apparatus according to claim 3 in which said strip attaching means comprises an elongated slot in the exterior surface of said body for receiving the free end of said strip.

* * * * *

UNITED STATES PATENT AND TRADEMARK OFFICE

CERTIFICATE OF CORRECTION

PATENT NO. : 4,267,984

DATED : May 19, 1981

INVENTOR(S) : William A. Box

It is certified that error appears in the above-identified patent and that said Letters Patent are hereby corrected as shown below:

Column 1, line 25, delete "now U. S. Pat. No. 4,191,318,".

Signed and Sealed this

*Twenty-fifth* Day of *August 1981*

[SEAL]

*Attest:*

GERALD J. MOSSINGHOFF

*Attesting Officer*

*Commissioner of Patents and Trademarks*